US006254659B1

(12) United States Patent
Schrey et al.

(10) Patent No.: US 6,254,659 B1
(45) Date of Patent: Jul. 3, 2001

(54) RARE EARTH - IRON -BORON PERMANENT MAGNET AND METHOD FOR THE MANUFACTURE THEREOF

(75) Inventors: Peter Schrey, Seeheim-Jugenheim; Mircea Velicescu, Waldshut, both of (DE)

(73) Assignee: Vacuumschmeleze GmbH, Hanau (DE)

( * ) Notice: Subject to any disclaimer, the term of this patent is extended or adjusted under 35 U.S.C. 154(b) by 0 days.

(21) Appl. No.: 09/242,985

(22) PCT Filed: Aug. 19, 1997

(86) PCT No.: PCT/DE97/01784

§ 371 Date: Feb. 26, 1999

§ 102(e) Date: Feb. 26, 1999

(87) PCT Pub. No.: WO98/10436

PCT Pub. Date: Mar. 12, 1998

(30) Foreign Application Priority Data

Sep. 6, 1996 (DE) ..... 196 36 284

(51) Int. Cl.[7] ..... C22C 29/14

(52) U.S. Cl. ..... 75/244; 419/38; 419/12; 148/302; 148/101

(58) Field of Search ..... 148/302, 101, 148/102, 103, 104; 419/12, 38; 75/244

(56) References Cited

U.S. PATENT DOCUMENTS

| | | | | |
|---|---|---|---|---|
| 5,230,751 | | 7/1993 | Endoh et al. . | |
| 5,405,455 | | 4/1995 | Kusunoki et al. . | |
| 5,447,578 | | 9/1995 | Ozaki et al. | 148/302 |
| 5,595,608 | * | 1/1997 | Takebuchi et al. | 148/104 |
| 6,045,751 | * | 4/2000 | Buschow et al. | 417/23 |

FOREIGN PATENT DOCUMENTS

| | | | |
|---|---|---|---|
| 41 35 403 | | 4/1993 | (DE) . |
| 0 517 179 | | 12/1992 | (EP) . |
| 0 583 041 | | 2/1994 | (EP) . |
| 0 651 401 | | 5/1995 | (EP) . |
| 6-207203 | * | 7/1994 | (JP) . |

* cited by examiner

*Primary Examiner*—John Sheehan
(74) *Attorney, Agent, or Firm*—Schiff Hardin & Waite

(57) ABSTRACT

A permanent magnet has a base composition of SE—Fe—B, wherein SE is at least one rare earth element, including Y, and having the tetragonal phase $SE_2Fe_{14}B$ as the principal phase, and additionally having an iron-free and boron-free phase of the general formula $SE_5$(Co, Ga), as a binder alloy. In a method for making such a permanent magnet, a powder of a base ally having the tetragonal phase composition, and a binder alloy having the aforementioned general formula composition, are mixed in a weight ration between 99:1 and 90:10.

3 Claims, 2 Drawing Sheets

RARE EARTH - IRON -BORON PERMANENT MAGNET AND METHOD FOR THE MANUFACTURE THEREOF

BACKGROUND OF THE INVENTION

1. Field of the Invention

The present invention is directed to a permanent magnet of the type SE—Fe—B that has the tetragonal phase $SE_2Fe_4B$ as the principal phase, wherein SE is at least one rare earth element, including Y.

2. Description of the Prior Art

A magnet of the above general type is disclosed, for example, by in European Application 0 124 655 and in U.S. Pat. No. 5,230,751 that corresponds thereto. Magnets of the type SE—Fe—B exhibit the highest energy densities currently available. SE—Fe—B magnets manufactured by powder metallurgy contain approximately 90% of the hard-magnetic principal phase $SE_2Fe_{14}B$.

German Offenlegungsschrift 41 35 403 discloses a two-phase magnet, wherein the second phase can be a SE—Fe—Co—Ga phase.

European Application 0 583 041 likewise discloses a two-phase magnet, wherein second phase is composed of a SE—Ga phase.

U.S. Pat. No. 5,447,578 discloses a SE-transition metal-Ga phase.

Conventionally in the manufacture of these Se—Fe—B-magnets by combining Se—Fe—B base alloys with the composition close to the $SE_2Fe_{14}B$ phase with a binder alloy with a lower melting temperature. The goal is thereby that the structure of the SE—Fe—B sintered magnets of $SE_2Fe_{14}B$ base alloys is set with inter-granular binders, using optimally little binder alloy.

European Application 0 517 179 proposes the employment of binder alloys having the composition $Pr_{20}Dy_{10}Co_{40}B_6Ga_4Fe_{rest}$ (in weight percent, this is Pr≈35, Dy≈20, Co≈28, B≈0.77, Ga≈3.5).

It has now turned out that the proportion of this binder alloy in the mixture of the base alloy must lie within 7–10 weight %. In this mixing range, sinter densities of approximately $\rho > 7.55$ g/cm$^3$ are achieved only at sintering temperatures above 1090° C. These sinter densities roughly correspond to 99% of the theoretical density. Outside this mixing range, the sinterability, and thus the remanence that can be achieved are considerably influenced. The grain growth is highly activated in the magnets with a proportion of this binder alloy of more than 10 weight %, but the pores are not closed. The consequence is the formation of a structure with anomalously large grains (>50 $\mu$m) and with high porosity as well as with low sinter densities. Given lower proportions of binder alloy, the amount of the fluid phase is accordingly not adequate for the densification.

SUMMARY OF THE INVENTION

It is an object of the present invention to provide a permanent magnet of the type SE—Fe—B manufactured by powder metallurgy that exhibits an enhanced sinterability compared to the known magnets upon reduction of the proportion of binder alloy and also exhibits a very good remanence, and to also specify a method for the manufacture thereof.

The object is inventively achieved by a permanent magnet that additionally contains an iron-free and boron-free phase of the general formula $SE_5(Co, Ga)_3$ as binder alloy, wherein SE is at least one rare earth element, including Y.

The inventive permanent magnet is expediently manufactured with a method having the following steps:

$a_1$) a powder of a base alloy of the general formula $$SE_2T_4B,$$

wherein SE is at least one rare earth element, including Y, and T is Fe or a combination of Fe and Co, whereby the Co part does not exceed 40 weight % of the combination of Fe and Co, $a_2$) and a powder of a binder alloy of the general formula $$SE'_5T_3,$$

wherein SE' is at least one rare earth element, including Y, and T is a combination of Co and Ga are mixed in a weight ratio of 99:1 to 90:10;

b) the mixture is compressed and, subsequently, c) is sintered in a vacuum and/or in an inert gas atmosphere.

It has been shown that permanent magnets manufactured in this way exhibit very high remanences, and that the proportion of binder alloy compared to the proportion of the base alloy can be reduced to below 7 weight %. Further, the additional gallium-containing phase of the binder alloy exhibits especially good wetting properties.

DESCRIPTION OF THE PREFERRED EMBODIMENTS

The invention is explained in greater detail below on the basis of the exemplary embodiments and the figures. A $Nd_2Fe_{14}B$ base alloy and a binder alloy with the following composition were employed for the investigation:

| Element | $Nd_2Fe_{14}B$ (weight %) | Binder Alloy (weight %) |
|---|---|---|
| Nd | 27.55 | 34.65 |
| Pr | 0.07 | 39.15 |
| Dy | 0.07 | 5.05 |
| Sum SE | 27.55 | 78.95 |
| Co | 0 | 13.15 |
| Ga | 0 | 7.2 |
| B | 1.01 | 0 |
| Fe | balance | 0 |

The scanning electron microscope investigations showed that the structure of the binder alloy is mainly composed of a ⅔ phase. The DTA/DDTA curves of coarse powders of the binder alloy exhibit endothermic maximums in the temperature range 530 through 610°. They correspond to the melting temperatures of ⅔ phases and are dependent on the Pr, Nd and Dy parts.

The following mixtures were prepared from coarse powders of these alloys.

| Magnet No. | $Nd_2Fe_{14}B$ (weight %) | Binder Alloy (weight %) |
|---|---|---|
| 322/1 | 95 | 5 |
| 322/2 | 96 | 4 |

The calculated composition of the manufactured magnets then derive:

| Element | Magnet 322/1 (weight %) | Magnet 322/2 (weight %) |
|---|---|---|
| Nd | 27.7 | 27.65 |
| Pr | 2.02 | 1.63 |
| Dy | 0.32 | 0.27 |
| Sum SE | 30.1 | 29.6 |
| B | 0.96 | 0.97 |
| Co | 0.66 | 0.53 |
| Ga | 0.36 | 0.29 |
| A1 | 0 | 0 |
| Fe | balance | balance |

The mixtures were finely ground for 90 minutes in a planetary ball mill; the average particle size of the fine powder achieved 2.9 through 3.0 $\mu$m. Anisotropic, isostatically pressed magnets were manufactured from the fine powders. They were sintered to densities of $\rho$>7.50 g/cm$^3$ and subsequently tempered.

Figure 1:
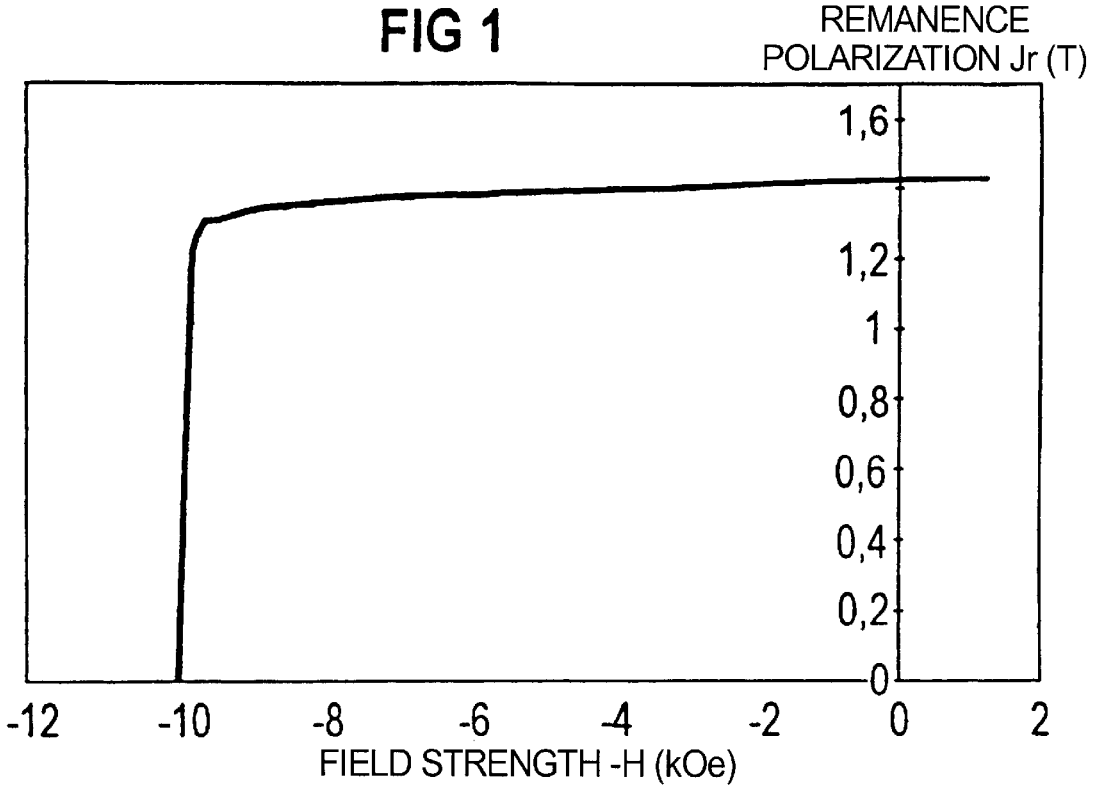
FIG. 1 shows the demagetization curve for Magnet No. 322/1, discussed below.
Figure 2:
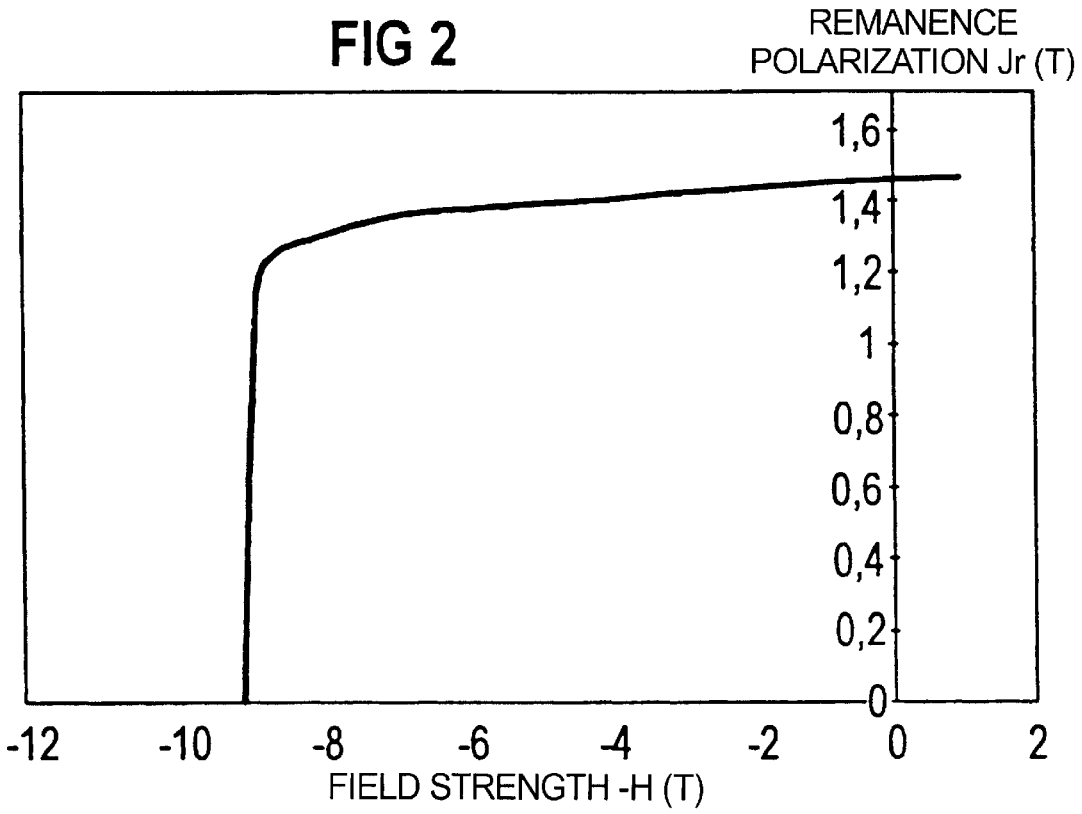
FIG. 2 shows the demagnetization curve for Magnet No. 322/2, discussed below.

FIGS. 1 and 2 show the demagnetization curves of the respective magnets at room temperature.

For comparison, a magnet according to the Prior art of a binder alloy with the composition of approximately 28 weight % Nd, 0.5 weight % Dy, 2.0 weight % Pr (sum SE≈30.5 weight %), 0.98 weight % B, 0.03 weight % Co and balance Fe was manufactured with the analogous powder-metallurgical method.

The same base alloy as in the magnet 322/1 from Example 1 was thereby employed as base alloy.

Figure 3:
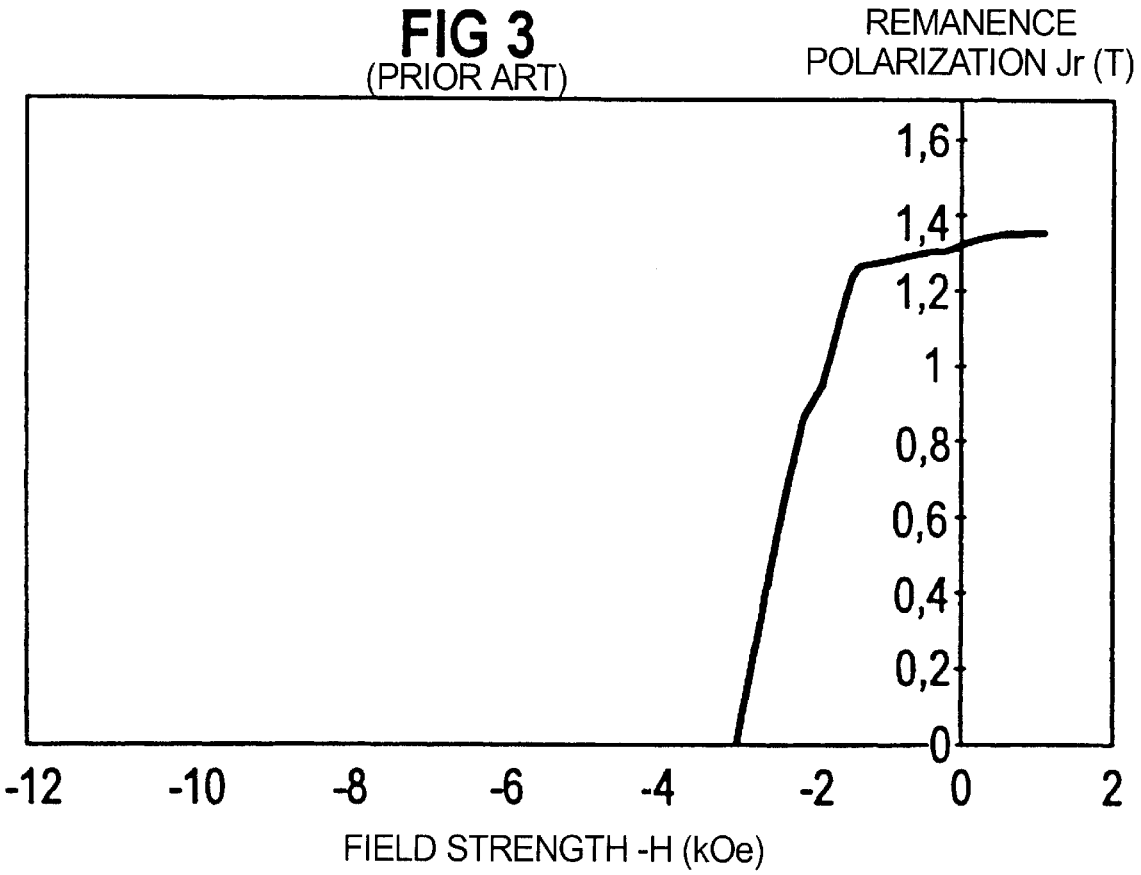
FIG 3 (PRIOR ART)
FIG. 3 shows the demagnetization curve of a magnet manufactured according to the conventional powder-metallurgical method.

FIG. 3 shows the demagnetization curve of this magnet that has been manufactured according to the conventional powder-metallurgical method according to the Prior art.

It can be clearly seen that the inventive permanent magnets exhibit a significantly more favorable demagnetization curve at room temperature than permanent magnets that have been manufactured according to the Prior Art.

The highest coercive field strength was achieved with magnet 322/1 after a tempering at a temperature of 630° C. The magnet 322/1, which was sintered at a temperature of 1080° C., achieved a coercive field strength of 10.4 koe, whereby its remanence amounts to 1.41 T. An alignment degree of the grains of 96% was measured in this magnet, and the relative density amounts to 98%. Computationally, a remanence of 1.415 T is thereby to be expected, i.e. a very good coincidence with the measured value.

The present invention presents a new boron-free and iron-free binder alloy with the composition $SE_5(Co, Ga)_3$ for manufacturing permanent magnets. The melting temperature of this binder alloy lies at approximately 530° C.

The employment of these $SE_5(Co, Ga)_3$ binder alloys for the powder-metallurgical manufacture of permanent magnets exhibits considerable advantages compared to the previous, multi-phase binder alloys.

Thus, the proportion of binder alloy can be decidedly reduced compared to the proportion of multi-phase binder alloys of the prior art, i.e. to a proportion below 7 weight %.

Although modifications and changes may be suggested by those skilled in the art, it is the intention of the inventors to embody within the patent warranted hereon all changes and modifications as reasonably and properly come within the scope of their contribution to the art.

What is claimed is:

1. Permanent magnet having a base composition SE—Fe—B and a principal phase comprising the tetragonal phase $SE_2Fe_{14}B$, said permanent magnet additionally comprising an iron-free and boron-free phase $SE_5(Co, Ga)_3$ as a binder alloy, wherein SE is at least one rare earth element, including Y.

2. Method for manufacturing a permanent magnet comprising the steps of:

$a_1$) mixing a powder of a magnetic base alloy of a general formula $$SE_2T_{14}B,$$

wherein SE is at least one rare earth element, including Y, and T is Fe or a combination of Fe and Co, Co does not exceed 40 weight % of the combination of Fe and Co, $a_2$) and a powder of magnetic binder alloy of a general formula $$SE_5(Co, Ga)_3,$$

in a weight ratio between 99:1 to 90:10 and thereby obtaining a mixture;

b) compressing the mixture to obtain a compressed mixture; and c) sintering the compressed mixture in an environment selected from the group consisting of a vacuum and an inert gas atmosphere.

3. A method according to claim, 2 wherein the step of mixing comprises mixing said base alloy and said binder alloy with a weight ratio of base alloy to binder alloy between 99:1 and 93:7.

* * * * *